US008096076B1

(12) United States Patent
Cerovic et al.

(10) Patent No.: US 8,096,076 B1
(45) **Date of Patent: *Jan. 17, 2012**

(54) SYSTEMS AND METHODS FOR A COVERED DEPLOYMENT UNIT FOR ELECTRONIC WEAPONRY

(75) Inventors: Milan Cerovic, Scottsdale, AZ (US); Magne H. Nerheim, Paradise Valley, AZ (US); Dubravko Zekanovic, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/962,814

(22) Filed: Dec. 8, 2010

Related U.S. Application Data

(63) Continuation of application No. 11/307,339, filed on Feb. 1, 2006, now Pat. No. 7,891,127.

(60) Provisional application No. 60/716,809, filed on Sep. 13, 2005.

(51) Int. Cl.
*F41A 19/00* (2006.01)

(52) U.S. Cl. ..... 42/84; 42/1.08; 361/232

(58) Field of Classification Search ..... 361/232; 102/502; 42/1.08, 84; 89/1.81, 1.817, 31
See application file for complete search history.

(56) References Cited

U.S. PATENT DOCUMENTS 62,947 A * 3/1867 Eddy ..... 292/102
195,595 A * 9/1877 Feige ..... 292/99
1,053,765 A * 2/1913 Wren ..... 292/19
1,123,997 A * 1/1915 Duepner ..... 292/285
1,148,668 A * 8/1915 Emery ..... 4/234
1,368,048 A * 2/1921 Pilliod ..... 70/69
1,394,659 A * 10/1921 Applegate ..... 292/95
2,014,367 A * 9/1935 Breegle ..... 102/436
3,089,420 A * 5/1963 Littleford ..... 102/470
3,404,598 A * 10/1968 Angelos ..... 89/1.14
3,802,430 A 4/1974 Schwebel
3,861,271 A * 1/1975 Osborn, Jr. ..... 89/1.8
3,932,721 A * 1/1976 Crowell et al. ..... 200/302.2
3,979,016 A * 9/1976 Frater ..... 220/315
4,204,473 A 5/1980 Dardick
4,478,150 A * 10/1984 Sayler et al. ..... 102/430
4,777,864 A 10/1988 Siech
4,884,357 A * 12/1989 Clifford ..... 43/25.2
4,938,146 A * 7/1990 Gunther et al. ..... 102/439
5,071,160 A * 12/1991 White et al. ..... 280/735
5,086,703 A * 2/1992 Klein ..... 102/439
5,296,659 A * 3/1994 Potts et al. ..... 200/83 J
5,309,842 A * 5/1994 Matysik et al. ..... 102/430
5,411,163 A * 5/1995 Gueret ..... 220/326
(Continued)

*Primary Examiner* — Bret Hayes
*Assistant Examiner* — Jonathan C Weber
(74) *Attorney, Agent, or Firm* — William R. Bachand; Lawrence Letham

(57) ABSTRACT

A deployment unit for use with an electronic weapon includes a body, an electrode, an electrical interface and tether wire, and a cover. The body has a cavity with an opening. The electrode is stored in the cavity. The electrical interface and tether wire conduct a current from the electronic weapon through the electrode. The cover is coupled to the body over the opening. Activation of a provided propellant, in any order (a) provides a force that pushes the cover away from the body to open the cavity; and (b) deploys the electrode from the cavity through the opening toward a provided target for conducting the current through the target that interferes with locomotion by the target. Prior to pushing the cover away from the body, no portion of the electrode contacts the cover.

21 Claims, 8 Drawing Sheets

U.S. PATENT DOCUMENTS 5,491,884 A * 2/1996 Potts et al. ..... 29/622
5,654,867 A * 8/1997 Murray ..... 361/232
5,692,773 A * 12/1997 Ono ..... 280/728.2
5,786,546 A * 7/1998 Simson ..... 102/438
5,791,327 A * 8/1998 Riggs et al. ..... 124/71
5,834,681 A * 11/1998 DuBay ..... 102/430
6,053,088 A * 4/2000 McNulty, Jr. ..... 89/1.11
6,247,412 B1 6/2001 Vornfett
6,269,726 B1 8/2001 McNulty
6,360,645 B1 * 3/2002 McNulty et al. ..... 89/1.11
6,715,789 B2 * 4/2004 Takimoto et al. ..... 280/730.1
6,729,222 B2 * 5/2004 McNulty, Jr. ..... 89/1.34
7,055,851 B2 * 6/2006 Takimoto et al. ..... 280/730.1
7,314,007 B2 * 1/2008 Su ..... 102/502
7,409,912 B2 * 8/2008 Cerovic et al. ..... 102/502
7,444,939 B2 11/2008 McNulty
7,600,337 B2 10/2009 Nerheim
7,631,452 B1 12/2009 Brundula
7,640,839 B2 1/2010 McNulty
7,673,411 B1 3/2010 Baldwin
7,778,004 B2 8/2010 Nerheim
7,891,128 B2 2/2011 Brundula
7,900,388 B2 3/2011 Brundula
7,905,180 B2 3/2011 Chen
7,944,676 B2 5/2011 Smith
2003/0094795 A1 * 5/2003 Takimoto et al. ..... 280/730.1
2005/0024807 A1 * 2/2005 Cerovic et al. ..... 361/232
2005/0109200 A1 5/2005 McNulty
2006/0187610 A1 * 8/2006 Su ..... 361/232
2006/0207466 A1 * 9/2006 McNulty et al. ..... 102/502
2007/0283834 A1 * 12/2007 Chen ..... 102/502

* cited by examiner

300

SYSTEMS AND METHODS FOR A COVERED DEPLOYMENT UNIT FOR ELECTRONIC WEAPONRY

CROSS-REFERENCE TO RELATED APPLICATIONS

This application is a continuation of and claims priority from U.S. patent application Ser. No. 11/307,339 filed Feb. 1, 2006 now U.S. Pat. No. 7,891,729 by Cerovic, et al., which claims the benefit of U.S. Provisional Patent Application 60/716,809 filed Sep. 13, 2005 by Nerheim, et al.

FIELD OF THE INVENTION

Embodiments of the present invention relate to weaponry including electronic control devices.

BACKGROUND OF THE INVENTION

Conventional electronic weaponry includes, for example, contact stun devices, batons, shields, stun guns, hand guns, rifles, mortars, grenades, projectiles, mines, and area protection devices among other apparatus generally suitable for ensuring compliance with security and law enforcement. This type of weaponry when used against a human or animal target causes an electric current to flow through part of the target's tissue to interfere with the target's use of its skeletal muscles. All or part of an electronic circuit may be propelled toward the target. In an important application of electronic weaponry, terrorists may be stopped in assaults and prevented from completing acts involving force to gain unlawful control of facilities, equipment, operators, innocent citizens, and law enforcement personnel. In other important applications of electronic weaponry, suspects may be arrested by law enforcement officers, and the cooperation of persons in custody may be maintained by security officers. An electronic weapon generally includes a circuit that generates a stimulus signal and one or more electrodes. In operation, for example to stop a terrorist act, the electrodes are propelled from the electronic weaponry toward the person to be stopped or controlled. After impact, a pulsing electric current is conducted between the electrodes sufficient for interfering with the person's use of his or her skeletal muscles. Interference may include involuntary, repeated, intense, muscle contractions at a rate of 5 to 20 contractions per second.

Research has shown that the intensity of the muscle contractions and the extent of the body affected with muscle contractions depend on several factors including the extent of the body conducting, charged, or discharged by the pulsing electric current. The extent is generally greater with increased distance between the electrodes. A minimum suitable distance is typically about 7 inches. Prior to propulsion, electrodes are typically stored much closer together and spread apart in flight toward the target. It is desirable to improve the accuracy with which the electrodes strike the target.

Conventional electronic weaponry has limited application, limited useful range, and limited accuracy. Without the present invention, more accurate and reliable electronic weaponry having longer range, and multiple functionality cannot be produced within existing economic limitations.

SUMMARY OF THE INVENTION

A deployment unit for use with an electronic weapon, according to various aspects of the present invention, includes a body, an electrode, an electrical interface and tether wire, and a cover. The body has a cavity with an opening. The electrode is stored in the cavity. The electrical interface and tether wire conduct a current from the electronic weapon through the electrode. The cover is coupled to the body over the opening. Activation of a provided propellant, in any order (a) provides a force that pushes the cover away from the body to open the cavity; and (b) deploys the electrode from the cavity through the opening toward a provided target for conducting the current through the target that interferes with locomotion by the target. Prior to pushing the cover away from the body, no portion of the electrode contacts the cover.

Another deployment unit for use with an electronic weapon, according to various aspects of the present invention, includes a body, an electrode, an electrical interface and tether wire, a cover, and a ram. The body has a cavity. The electrode is stored in the cavity. The electrical interface and tether wire conduct a current from the electronic weapon through the electrode. The cover includes at least one fastener that mechanically couples to the body to retain the cover over the cavity. Activation of a provided propellant urges the ram against the cover to permit exit of the electrode from the cavity toward a provided target for conducting the current through the target. The current interferes with locomotion by the target. After exit of the electrode, the ram falls away from the trajectory of the electrode.

An electronic weapon, according to various aspects of the present invention, includes a circuit, a propellant, a body, an electrode, an electrical interface and a tether wire, and a cover. The circuit provides a current. The body includes a cavity. The electrode is stored in the cavity. The electrical interface and tether wire conduct the current from the electronic weapon through the electrode. The cover is coupled to the body to cover the cavity. Activation of the propellant, in any order (a) uncovers the cavity; and (b) deploys the electrode from the uncovered cavity toward a provided target for conducting the current through the target. The current interferes with locomotion by the target. Prior to uncovering the cavity, no portion of the electrode contacts the cover.

Another electronic weapon, according to various aspects of the present invention, includes a circuit, a propellant, a body, an electrode, an electrical interface and tether wire, a cover, and a ram. The circuit provides a current. The body includes a cavity. The electrode is stored in the cavity. The electrical interface and tether wire conduct the current from the electronic weapon through the electrode. The cover includes at least one fastener that mechanically couples to the body to retain the cover over the cavity whereby the cover blocks exit of the electrode from the cavity. Activation of the propellant urges the ram against the cover to permit exit of the electrode from the cavity toward a provided target for conducting the current through the target. The current interferes with locomotion by the target. After exit of the electrode, the ram falls away from the trajectory of the electrode.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
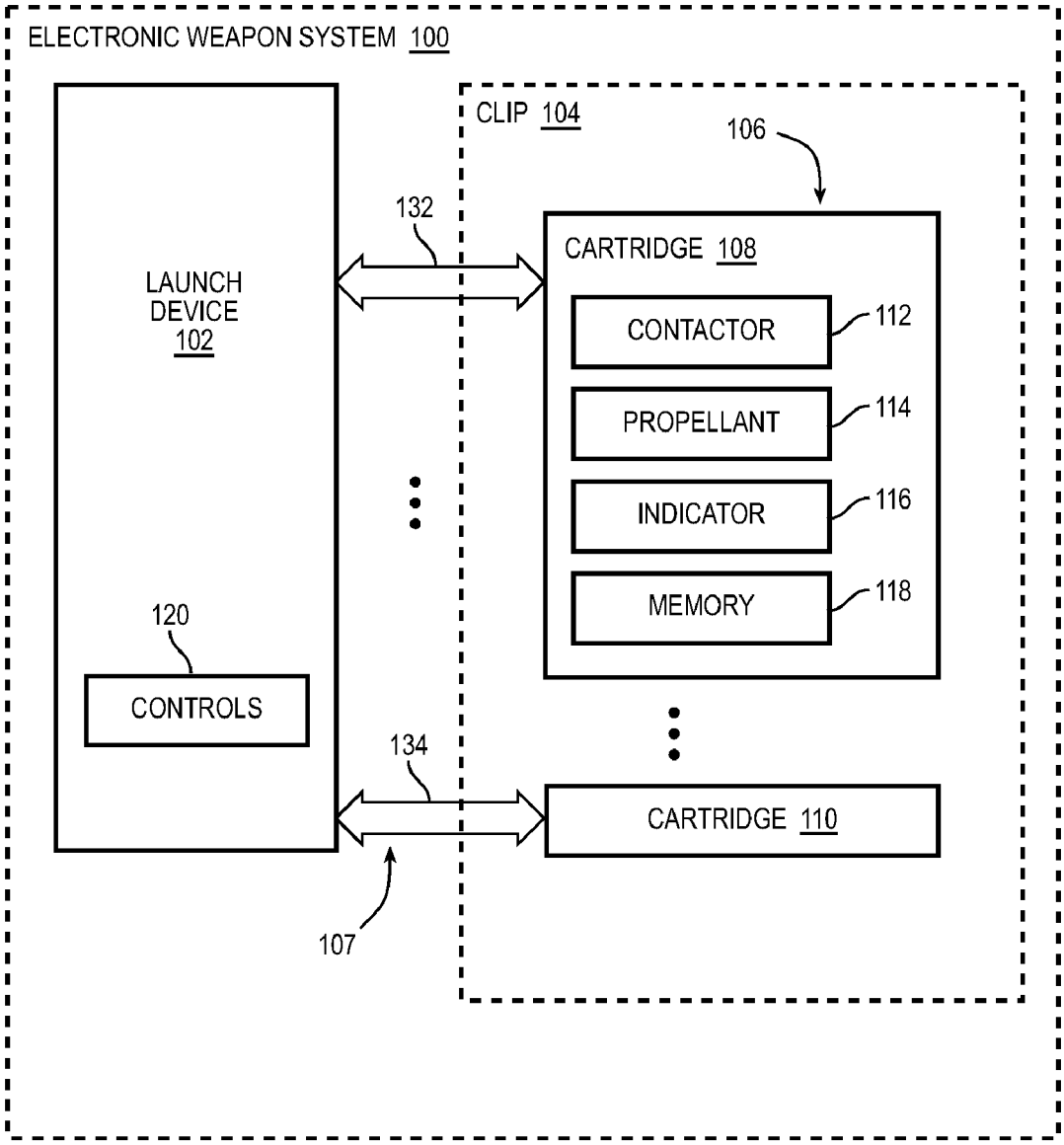
FIG. 1 is a functional block diagram of an electronic weapon system according to various aspects of the present invention.
Figure 2:
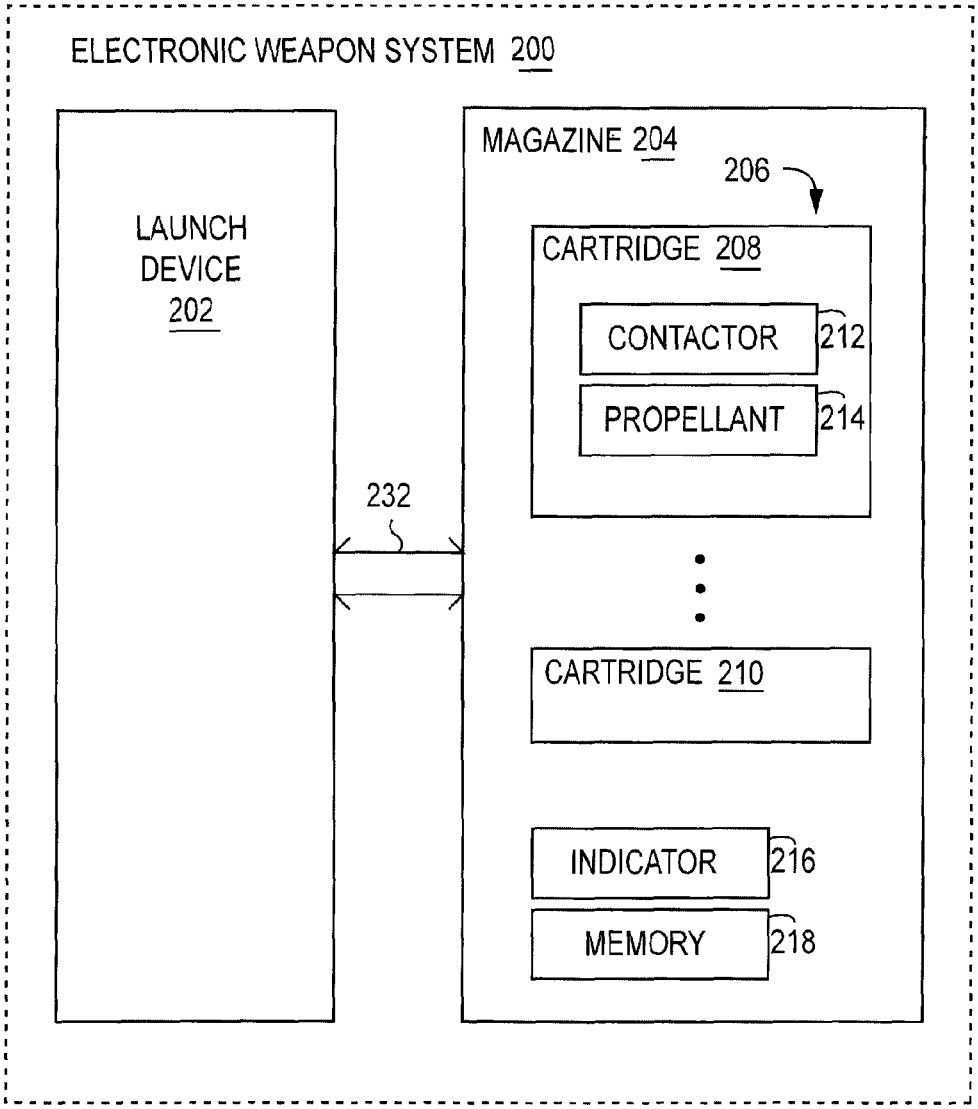
FIG. 2 is a functional block diagram of another electronic weapon system according to various aspects of the present invention.
Figure 3:
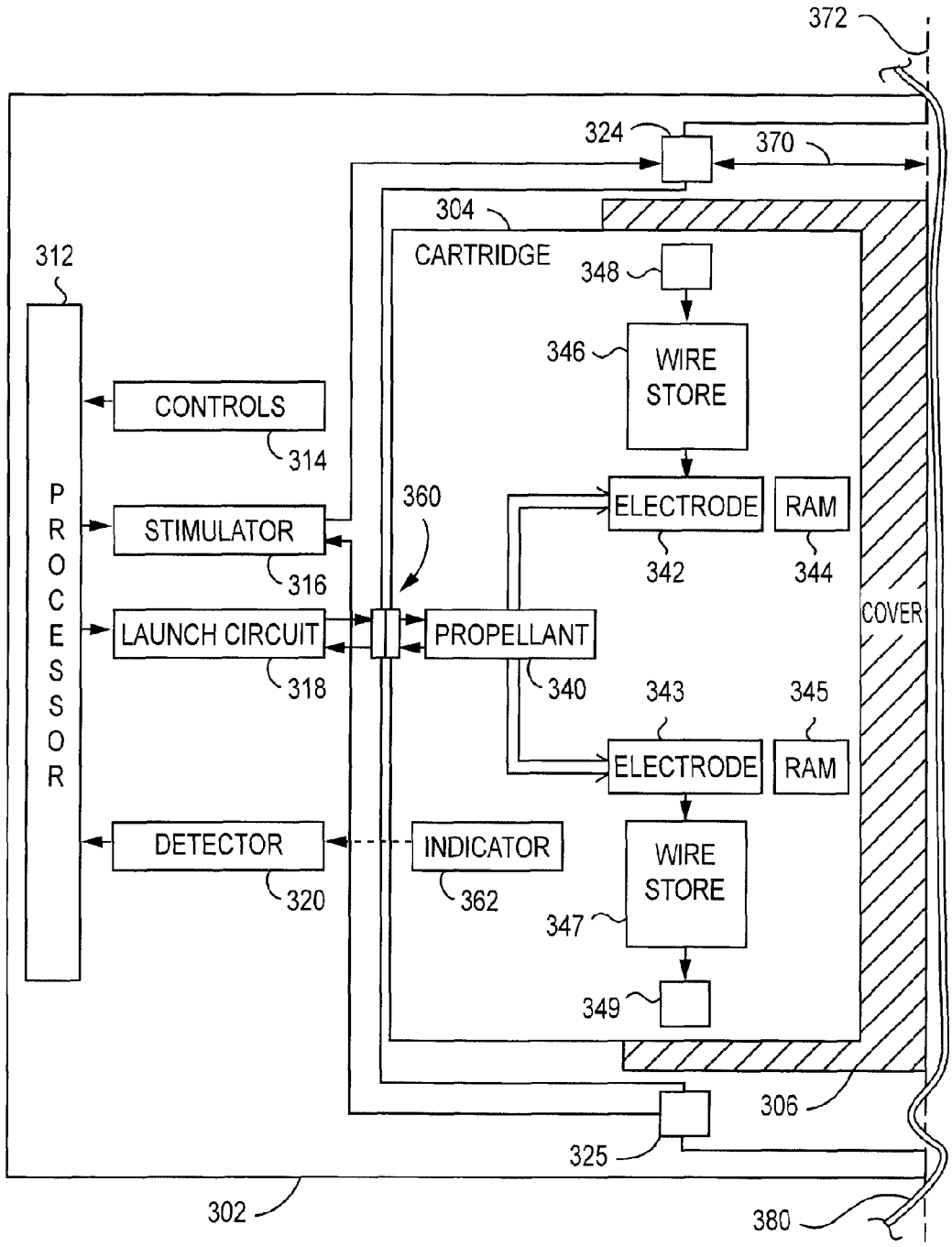
FIG. 3 is a functional block diagram of a launch device and a deployment unit according to various aspects of the present invention.
Figure 4:
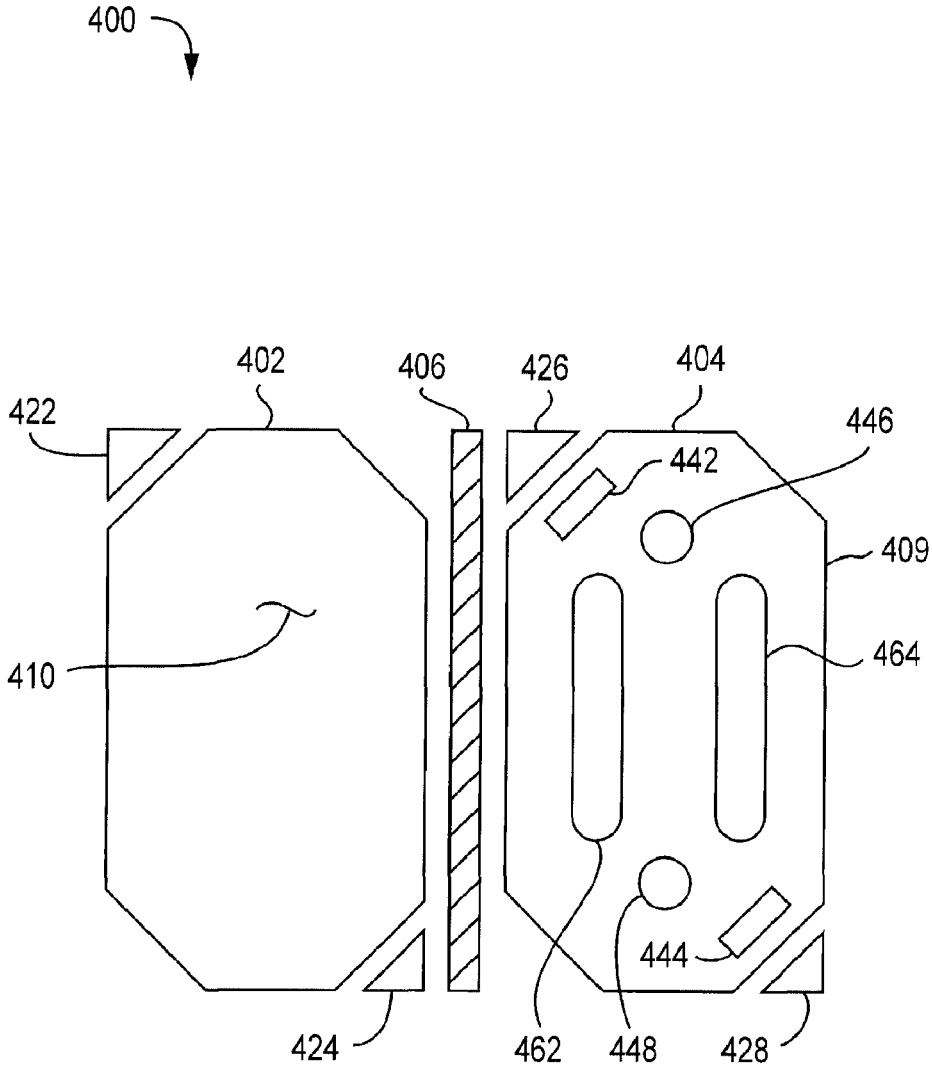
FIG. 4 is a is a front plan view of a weapon with two cartridges according to various aspects of the present invention.
Figure 5:
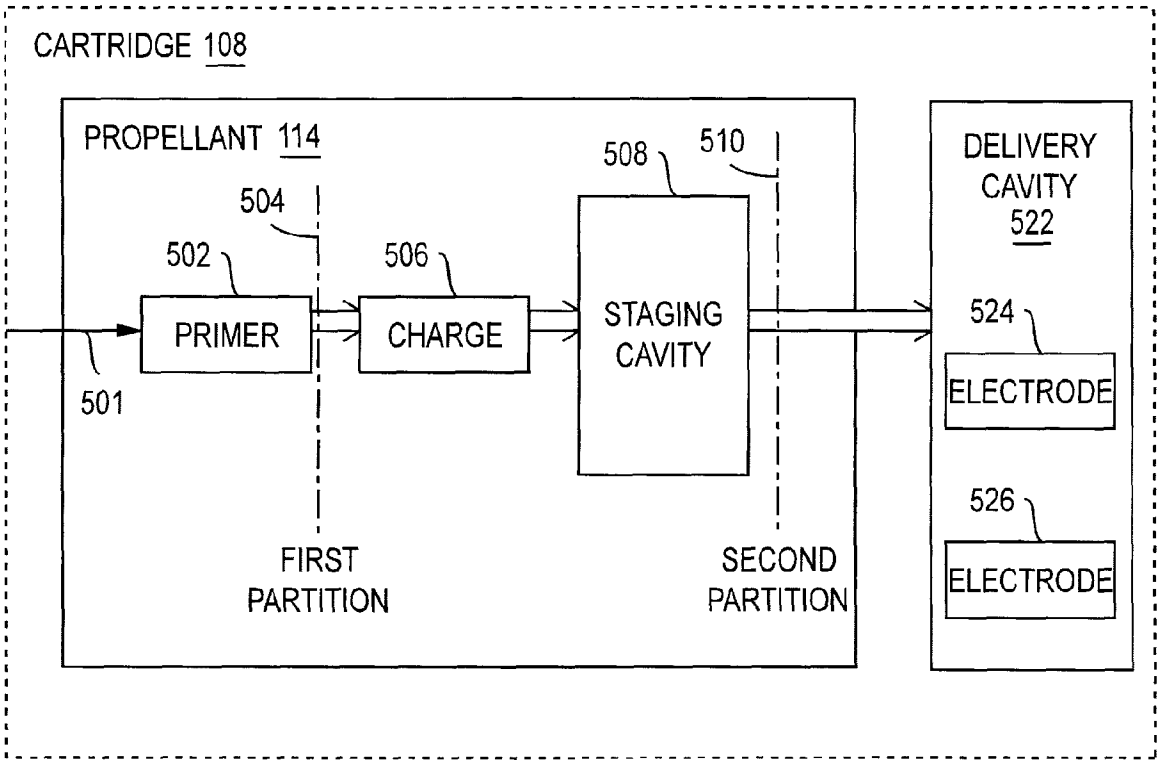
FIG. 5 is a functional block diagram of a cartridge for use with the weapon of FIG. 1, 2, 3, or 4.

Greater utility and improved accuracy of electronic weapon systems can be obtained by eliminating several problems exhibited by conventional electronic weapon systems. A conventional electronic weapon may perform a contact (or proximate) stun function (herein called a local stun function) of subduing an animal or person (herein called a target) by abutting (or bringing proximate) at least two terminals of the weapon to the skin or clothing of the target. Another conventional electronic weapon may perform a remote stun function of subduing a target by launching one or more wire tethered electrodes from the weapon to the target so that the electrodes are proximate to or impale the skin or clothing of the target. In either the local stun function or the remote stun function, an electric circuit is formed for passing a pulsing current through a portion of the tissue of the target to interfere with skeletal muscle control by the target. When a terminal or an electrode is proximate to the tissue of the target, an arc is formed in the air to complete a circuit for current to flow through the tissue of the target.

An electronic weapon system according to various aspects of the present invention may perform alternatively the local stun function and the remote stun function without operator intervention to mechanically reconfigure the electronic weapon system. The local stun function may be available at a front face of any loaded, spent, or unspent cartridge. Multiple unspent cartridges may be loaded individually, by a clip, or by a magazine prior to use of the electronic weapon system to provide multiple operations of the remote stun function.

Electrodes, tether wires, and a propellant system are conventionally packaged as a cartridge that is mounted on the electronic weapon to form an electronic weapon system for a single remote stun use. After deployment of the electrodes, the spent cartridge is removed from the electronic weapon and replaced with another cartridge. A cartridge may include several electrodes launched at once as a set, launched at various times as sets, or individually launched. A cartridge may have several sets of electrodes each for independent launch in a manner similar to a magazine.

An electronic weapon system according to various aspects of the present invention maintains several cartridges ready for use. If, for example, a first attempted remote stun function is not successful (e.g., an electrode misses the target or the electrodes short together), a second cartridge may be used without operator intervention to mechanically reconfigure the electronic weapon system. Several cartridges may be mounted simultaneously (e.g., as a clip or magazine), or sequentially (e.g., any cartridge may be removed and replaced independently of the other cartridges).

Accuracy of a remote stun function is dependent on, among other things, a repeatable trajectory of each electrode launched away from the electronic weapon. A conventional cartridge includes a delivery cavity for holding the electrode prior to delivery and for guiding the electrode during the early moments of deployment. Deployment is conventionally accomplished by a sudden release of gas (e.g., pyrotechnic gas production or rupture of a cylinder of compressed gas). The electrode and the delivery cavity are kept free of contamination by being tightly covered. When the electrode is deployed, it pulls its wire tether from a wire store so that the wire tether extends behind the electrode to the weapon during flight.

Cartridges, according to various aspects of the present invention, exhibit improved accuracy by providing a more repeatable opening of the covered delivery cavity and/or compensation for drag due to the wire tether. Compensation may be accomplished by orienting the axis of the delivery cavity in a preferred direction and/or using a particular shape for the delivery cavity.

A conventional cartridge may be constructed to provide a suitable range of effective distance. The range of effective distance provides a suitable spread of electrodes (e.g., greater than about 6 inches (15 cm)) on impact with the target when the target exists at a specified range of distances from the weapon (e.g., from about 6 to about 15 feet (2 m to 5 m)).

An electronic weapon system, according to various aspects of the present invention, supports use of a set of cartridges each having a different range of effective distance in part due to each cartridge (or magazine) providing to the weapon various indicia of its capabilities (or codes from which capabilities may be determined). A cartridge, a clip, and a magazine are particular examples of apparatus generally referred to herein as a deployment unit. The electronic weapon system may be operated to launch a particular cartridge (or particular electrode set of a cartridge having several sets of electrodes) suitable for a particular application of the remote stun function.

Greater utility and/or improved accuracy as discussed above are accomplished by an electronic weapon system constructed and operated according to various aspects of the present invention. For example, electronic weapon systems may be constructed in accordance with one or more of FIGS. 1 through 9. In particular, for clarity of presentation, consider electronic weapon system 100 of FIG. 1. Electronic weapon system 100 includes launch device 102 cooperating with a set (or plurality) 106 of cartridges 108 (110) that may be mounted to launch device individually or as a set, for example, in one or more clips 104. Set 106 may include 2 or more cartridges (e.g., 3, 4, 5, 6, or more). When each cartridge is spent, the cartridge may be replaced individually. Cartridges in set 106 may be identical or may vary (e.g., inter alia in capabilities, manufacturer, manufacturing date).

Launch device 102 communicates with each cartridge 108 (110) of set 106 via an interface 107. Launch device 102 provides power, launch control signals, and stimulus signals to each cartridge. Various ones of these signals may be in common or (preferably) unique to each cartridge. Each cartridge 108 (110) provides signals to launch device 102 that convey indicia, for example, of capabilities, as discussed above and further below.

A launch device includes any device for operating one or more deployment units. A launch device may be packaged as a contact stun device, baton, shield, stun gun, hand gun, rifle, mortar, grenade, projectile, mine, or area protection device. For example, a gun type launch device may be hand-held by an operator to operate one or more cartridges at a time from a set or magazine of cartridges. A mine type launch device (also called an area denial device) may be remotely operated (or operated by a sensor such as a trip wire) to launch one or more cartridges substantially simultaneously. A grenade type launch device may be operated from a timer to launch one or more cartridges substantially simultaneously. A projectile type launch device may be operated from a timer or target sensor to launch plural electrode sets at multiple targets.

A cartridge includes one or more wire tethered electrodes, a wire store for each electrode, and a propellant. The thin wire is sometimes referred to as a filament. Upon installation to launch device 102 of a deployment unit having a cartridge, launch device 102 determines the capabilities of at least one and preferably all cartridges of the deployment unit. Launch device 102 may write information to be stored by the cartridge (e.g., inter alia, identity of the launch device, identity of the operator, configuration of the launch device, GPS position of the launch device, date/time, primary function performed).

On operation of a control of controls 120 of launch device 102, launch device 102 provides a stimulus signal for a local stun function. On operation of another control of controls 120 of launch device 102, launch device 102 provides a launch signal to one or more cartridges of a deployment unit (e.g., 104) to be launched and may provide a stimulus signal to each cartridge to be used for a remote stun function. Determination of which cartridge(s) to launch may be accomplished by launch device 102 with reference to capabilities of the installed cartridges and/or operation of controls by an operator. According to various aspects of the present invention, the launch signal has a voltage substantially less than a voltage of the stimulus signal; and, the launch signal and stimulus signal may be provided simultaneously or independently according to controls 120 of launch device 102 and/or according to a configuration of launch device 102.

A cartridge includes any expendable package having one or more wire tethered electrodes. As such, a magazine or a clip is a type of cartridge. According to various aspects of the present invention, cartridge 108 (110) of FIG. 1 includes an interface 107 for signals 132 (134), a contactor 112, a propellant 114, an indicator 116, and a memory 118. In another implementation, indicator 116 is omitted and memory 118 performs functions of providing any or all of the indications discussed below with reference to indicator 116. In another implementation, memory 118 is omitted for decreasing the cost and complexity of the cartridge.

Interface 107 supports communication in any conventional manner and as discussed herein. Interface 107 may include mechanical and/or electrical structures for communication. Communication may include transmitting and/or receiving radio frequency signals, conducting electrical signals (e.g., connectors, spark gaps), supporting magnetic circuits, and passing optical signals.

A contactor brings the stimulus signal into proximity or contact with tissue of the target (e.g., an animal or person). Contactor 112 performs both the local stun function and the remote stun function as discussed above. For the remote stun function, contactor 112 includes electrodes that are propelled by propellant 114 away from cartridge 108. Contactor 112 provides electrical continuity between a stimulus signal generator in launch device 102 and terminals for the local stun function. Contractor 112 also provides electrical continuity between the stimulus signal generator in launch device 102 and the captive end of the wire tether for each electrode for the remote stun function. Contactor 112 receives stimulus control signals 132 from interface 107 and may further include a stimulus signal generator.

A propellant propels electrodes away from cartridge 108. For example, propellant 114 may include a compressed gas container that is opened to drive electrodes via expanding gas escaping the container. Propellant 114 may in addition or alternatively include conventional pyrotechnic gas generation capability (e.g., gun powder, a smokeless pistol powder). Preferably, propellant 114 includes an electrically enabled pyrotechnic primer that operates at a relatively low voltage (e.g., less than 1000 volts) compared to the stimulus signal delivered via contactor 112.

An indicator includes any apparatus that provides information to a launch device. An indicator cooperates with a launch device for automatic communication of indicia conveying information from the indicator to the launch device. Information may be communicated in any conventional manner including sourcing a signal by the indicator or modulating by the indicator a signal sourced by the launch device. Information may be conveyed by any conventional property of the communicated signal. For example, indicator 116 may include a passive electrical, magnetic, or optical circuit or component to affect an electrical charge, current, electric field, magnetic field, magnetic flux, or radiation (e.g., light) sourced by launch device 102. Presence (or absence) of the charge, current, field, flux, or radiation at a particular time or times may be used to convey information via interface 107. Relative position of the indicator with respect to detectors in launch device 102 may convey information. In various implementations, the indicator may include one or more of any of the following: resistances, capacitances, inductances, magnets, magnetic shunts, resonant circuits, filters, optical fiber, reflective surfaces, and memory devices.

In one implementation, indicator 116 includes a conventional passive radio frequency identification tag circuit (e.g., having an antenna or operating as an antenna). In another implementation, indicator 116 includes a mirrored surface or lens that diverts light sourced by launch device 102 to predetermined locations of detectors or sensitive areas in launch device 102. In another implementation, indicator 116 includes a magnet, the position and polarity thereof being detected by launch device 102 (e.g., via one or more reed switches). In still another implementation, indicator 116 includes one or more portions of a magnetic circuit, the presence and/or relative position of which are detectable by the remainder of the magnetic circuit in launch device 102. In another implementation, indicator 116 is coupled to launch device 102 by a conventional connector (e.g., pin and socket). Indicator 116 may include an impedance through which a current provided by launch device 102 passes. This latter approach is preferred for simplicity but may be less reliable in contaminated environments.

Indicator 116 in various embodiments includes any combination of the above communication technologies. Indicator 116 may communicate using analog and/or digital techniques. When more than one bit of information is to be conveyed, communication may be in serial, time multiplexed, frequency multiplexed, or communicated in parallel (e.g., multiple technologies or multiple channels of the same technology).

The information indicated by indicator 116 may be communicated in a coded manner (e.g., an analog value conveys a numerical code, a communicated value conveys an index into a table in the launch device that more fully describes the meaning of the code). The information may include a description of cartridge 108, including for example, the quantity of uses (e.g., one, plural, quantity remaining) available from this cartridge (e.g., may correspond to the quantity of electrode pairs in the cartridge), a range of effective distance for each remote stun use, whether or not the cartridge is ready for a next remote stun use (e.g., indication of a fully spent cartridge), a range of effective distance for all or the next remote stun use, a manufacturer of the cartridge, a date of manufacture of the cartridge, a capability of the cartridge, an incapability of the cartridge, a cartridge model identifier, a serial number of the cartridge, a compatibility with a model of launch device, an installation orientation of the cartridge (e.g., where plural orientations may be used with different capabilities (e.g., effective distances) in each orientation), and/or any value(s) stored in memory 118 (e.g., stored at the manufacturer, stored by any launch device upon installation of the cartridge with that particular launch device).

A memory includes any analog or digital information storage device. For example, memory 118 may include any conventional nonvolatile semiconductor, magnetic, or optical memory. Memory 118 may include any information as discussed above and may further include any software to be performed by launch device 102. Software may include a driver for this particular cartridge to facilitate suitable (e.g., plug and play) operation of indicator 116, propellant 114, and/or contactor 112. Such functionality may include a stimulus signal particular to the use the cartridge is supplied to fulfill. For example, one launch device may be compatible with four types of cartridges: military, law enforcement, commercial security, and civilian personal defense, and apply a particular launch control signal or stimulus signal in accordance with software read from memory 118.

Another embodiment of an electronic weapon system according to various aspects of the present invention operates with a magazine as discussed above. For example, electronic weapon system 200 of FIG. 2 includes launch device 202 cooperating with magazine 204. Signals in interface 232 between launch device 202 and magazine 204 may be identical, substantially similar, or analogous to communication between a launch device and a cartridge as discussed above with reference to FIG. 1.

A magazine provides mechanical support and may further provide communication support for a plurality of cartridges. For example, magazine 204 includes plurality of cartridges 206 having cartridge 208 through 210, indicator 216 and memory 218. Cartridge 208 comprising contactor 212 and propellant 214 may be identical in structure and function to cartridge 108 discussed above except that indicator 116 and memory 118 are omitted. Indicator 216 performs functions with respect to magazine 204 and its cartridges 206 that are analogous to the functions of indicator 116 discussed above with respect to cartridge 108. Memory 218 performs functions with respect to magazine 204 and its cartridges 206 that are analogous to the functions of memory 118 discussed above with respect to cartridge 108. Indicator 216 and/or memory 218 may store or convey information regarding multiple installations, cartridges, and uses. For example, since magazine 204 may be reloaded with cartridges and installed/removed/reinstalled on several launch devices, the date, time, description of cartridge, and description of launch device may be detected, indicated, stored, and/or recalled when change is detected or at a suitable time (e.g., recorded at time of use for a remote stun function). The quantity of uses may be recorded to facilitate periodic maintenance, warranty coverage, failure analysis, or replacement.

An electronic weapon system according to various aspects of the present invention may include independent electrical interfaces for launch control and stimulus signaling. The launch control interface to a single shot cartridge may include one signal and ground. The launch control signal may be a relatively low voltage binary signal. The stimulus signal may be independently available for local stun functions without and with a cartridge installed in the launch device. The stimulus signal may be available for remote stun functions after the cartridge propellant has been activated. For example, electronic weapon system 300 of FIG. 3 includes a launch device 302 and a deployment unit comprising any number of cartridges 304 (one shown for clarity of presentation).

Launch device 302 includes processor 312, controls 314, stimulator 316, launch circuit 318, detector 320, terminals 324 and 325. Cartridge 304 includes cover 306, propellant 340, electrodes 342 and 343, rams 344 and 345, wire stores 346 and 347, terminals 348 and 349, electrical interface 360, and indicator 362. These components cooperate to provide all of the functions discussed above. Other combinations of less than all of these functions may be implemented according to the present invention.

A processor includes any circuit for performing functions in accordance with a stored program. For example, processor 312 may include memory and a conventional sequential machine that executes microcode, or assembly language instructions from memory. A microprocessor, microcontroller, application specific integrated circuit, or digital signal processor may be used.

Launch device 302 in various forms as discussed above includes controls operated by the target (e.g., an area denial device), by an operator (e.g., a handgun type device), or by timing or sensor circuits (e.g., a grenade type device). A control includes any conventional manual or automatic interface circuit, such as a manually operated switch or relay. For a handgun type device, controls (not shown) may include any one or more of a safety switch, a trigger switch, a range priority switch, and a repeat stimulus switch. The safety switch may be read by the processor and effect a general enablement or disablement of the trigger and stimulus circuitry. The trigger switch may be read by the processor to effect operation of the propellant in a particular cartridge. The range priority switch may be read by the processor and effect selection by the processor of the cartridge to operate in response to a next operation of the trigger switch in accordance with a range of effective distance for the intended use indicated by the range priority switch. The repeat stimulus switch, when operated, may initiate another delivery of one or more stimulus signals for a local stun function or remote stun function via one or more cartridges 304.

A stimulator includes a circuit for generating a stimulus signal for passing a current through tissue of the target to interfere with operation of skeletal muscles of the target. Any conventional stimulus signal may be used. For example, stimulator 316 in one embodiment delivers about 5 seconds of 19 pulses per second, each pulse transferring about 100 microcoulombs of charge through the tissue in about 100 microseconds. Stimulator 316 may have a common interface to all cartridges 304 in parallel (e.g., simultaneous operation), or may have an individual independently operating interface to each cartridge 304 (as shown).

A launch circuit provides a signal sufficient to activate a propellant. For example, launch circuit 318 provides an electrical signal for operation of an electrically fired pyrotechnic primer. Interface 360 may be implemented with one conductor to propellant 340 (e.g., a pin) and a return electrical path through the body of propellant 340, the body of cartridge 304, and/or the body of launch device 302. Interface 360 may include conductive paths from stimulator 316 to wire stores 346 and 347 when terminals 348 and 349 are omitted. Use of terminals 348 and 349 reduces the possibility of unintentional activation of propellant 340 and destructive short circuits within cartridge 304 when performing the local stun function.

A propellant suitably presents a relatively low resistance to launch circuit 318 to reduce the possibility of unintended activation of the propellant by electrostatic discharge through the propellant.

Launch device 302 in configurations according to various aspects of the present invention launches any one or more electrodes of a deployment unit and provides the stimulus signal to any combination of local stun function terminals and remote stun function electrodes. For example, launch circuit 318 may provide a unique signal to each of several interfaces 360, each cartridge of the deployment unit having one independently operated interface 360. Stimulator 316 may provide a unique signal to each of several sets of terminals 324 and 325, each cartridge of the deployment unit having one independently operated set of terminals. Operation of an electronic weapon system having such a launch device and deployment unit facilitates multiple function operation. For instance, a set of electrodes may first be deployed for a remote stun function and subsequently a set of terminals (e.g., of or for an unspent cartridge) may then be used for a local stun function or for displaying an arc (e.g., as an audible and visible warning). When more than one set of electrodes have been deployed for remote stun functions, the remote stun functions may be performed on both targets together (e.g., in rapid sequence or simultaneously) or on a selected target.

A deployment unit may include several (e.g., 2 or more) sets of terminals for display and/or local stun function, and several (e.g., 2 or more) sets of electrodes, each set for a remote stun function. A set may include two or more terminals or electrodes. Launch of electrodes may be individual (e.g., for effective placement when the target is too close for adequate separation of electrodes in flight) or as a set (e.g., in rapid succession or simultaneous). In one implementation, a set of terminals and a set of electrodes is packaged as a cartridge, the deployment unit comprising several such cartridges. Before the electrodes of the cartridge are launched, a set of terminals of the electronic weapon (e.g., part of the launch device or part of a cartridge) may perform a display (e.g., a warning) function or a local stun function. In one implementation, after launch, only the remote stun function is performed from the spent cartridge; and other cartridges are available for the local stun or display functions. Because the deployment unit includes more than one cartridge each with an independent interface or interfaces, the deployment unit facilitates multiple functions as discussed herein.

For instance, after a first cartridge of such a deployment unit has been deployed toward a first target, stimulator 316 may be operated to provide a display or a local stun function with other terminals of the deployment unit. A second target may be engaged for a second remote stun function. Subsequently, other terminals of the deployment unit may be used for another display or local stun function. In one implementation, the deployment unit includes terminals for the local stun function independent of cartridge configurations (e.g., none, some or all installed; none, some or all spent).

A detector communicates with one or more indicators as discussed above. For example, detector 320 includes a sensor for detecting indicator 362 of each cartridge of a deployment unit. In one implementation, detector 320 includes a circuit having a reed relay to sense the existence of a magnet (or flux circuit) of suitable polarity and strength at one or more positions proximate to cartridge 304. The positions define a code as discussed above that is detected by detector 320 and read by processor 312 for governing operation of electronic weapon system 300. A deployment unit may have multiple indicators (e.g., one set of indicators for each cartridge). A detector may have a corresponding plurality of sensors (e.g., reed relays).

Terminals 324 and 325 provide multiple functions that may include a warning function and a local stun function. When cartridge 304 is not installed, the distance between terminals 324 and 325 may be short enough to allow a relatively high voltage stimulus signal to ionize the air between terminals 324 and 325 so that a spark is conducted between them. The noise and/or visual display of the spark may act as a warning to the target and promote cooperation. When terminals 324 and 325 are brought close to the tissue of a target (e.g., less than about 3 inches without heavy clothing), the stimulus signal may ionize air between the terminal and the tissue and pass through the tissue of the target. In another implementation, terminals 324 and 325 cooperate to accomplish a remote stun function.

When a face of electronic weapon system 300 is pressed into abutting contact with the tissue of the target, terminals for a local stun function do not come into abutting contact with the tissue of the target because these terminals are recessed from the face of system 300. By recessing the terminals, the possibility and extent of burn wounds on the target may be avoided or reduced. Recessing may be from about 0.1 inch to about 1.0 inch from a plane that includes the facial features of the electronic weapon. Recessing may be increased to account for the possibility that the target may be pliable and, consequently, a portion of the target's clothing or tissue may cross the plane at the face of the electronic weapon. For example, terminals 325 and 326 are recessed a distance 370 from a plane 372 defined by a set of points that in use may come into abutting contact with the target (shown in arbitrary cross-section as contour 380). An allowance may be made in distance 370 for use of system 300 against a pliable surface of the target (e.g., loose clothing, skin) that may move across plane 372 in response to the force of abutting system 300 against the target.

When a cartridge 304 is installed, cover 306 prevents conduction between terminals 324 and 325 through cartridge 304. Terminals 324 and 325 are still available for operation for warning and local stun functions as discussed above. In addition, when cover 306 is removed, terminals 324 and 325 operate in a circuit for the remote stun function.

A terminal 324 and/or 325 may be formed as a solid geometric object (e.g., a hexahedron, cylinder, sphere) or as a shape having a plurality of prongs or surfaces. In one implementation, terminals 324 and 325 are each formed with two prongs or surfaces. The first prong or surface is directed toward a face of the electronic weapon system 300 for performing a local stun function. The second prong or surface is directed toward terminal 348 for performing a remote stun function as discussed below.

Propellant 340 is of the type described above with reference to propellant 114. When activated by launch circuit 318, propellant 340 violently propels electrode 342 (and 343) out of cartridge 304. Each electrode 342 (343) mechanically urges a ram 344 (345) to push and or impact cover 306, pushing cover 306 away from cartridge 304 and ultimately falling away from the trajectory of the electrode 342 (343). Each electrode 342 and 343 is connected to a respective wire tether stored in wire stores 346 and 347. Each wire store 346 (347) is connected to a terminal 348 (349) in proximity to a terminal 324 (325) of launch device 302.

When propellant 340 is activated, cover 306 is removed, electrodes are propelled away from cartridge 304 on wire tethers, and a circuit is ready for conducting the stimulus signal. This circuit includes stimulator 316, terminal 324, terminal 348, wire of store 346, electrode 342, tissue of the target (presuming electrodes are successfully delivered proximate the target's tissue), electrode 343, wire of store 347, terminal 349, terminal 325 and back to stimulator 316. This circuit performs the remote stun function at a distance up to the length of the wire in stores 346 and 347. Wire may be about 9 feet to about 40 feet (3 m to 13 m) and consist of conventional materials (e.g., copper filament insulated with a suitable polymer for high voltage insulation).

A ram communicates a propulsion force against a cover to remove the cover. For example, ram 344 (345) is pushed by electrode 342 and/or gas from propellant 340 to impact cover 306 so as to push cover 306 away from cartridge 304. Preferably, ram 344 (345) is assembled into abutting contact between electrode 342 (343) and cover 306. Ram 344 (345) improves the effectiveness of an electrode 342 (343) to remove cover 306 in a repeatable manner with little or no change to the orientation and energy of the electrode, facilitating accurate delivery of the electrode.

Indicator 362 is of the type discussed above with reference to indicator 116. For example, for operation with detector 320 discussed above, indicator 362 may include one or more permanent magnets arranged within cartridge 304 to permit reliable operation of detector 320.

Cover 306 may be made of any insulating material, for example, plastic (e.g., polystyrene, polycarbonate).

Terminals of a launch device and of a cartridge may be located to facilitate use of multiple cartridges with the launch device. For example, the front face of a launch device (or magazine) of the type discussed above with reference to FIGS. 1 through 3 may be implemented with an insulating barrier between adjacent cartridges. For example, front face layout 400 of FIG. 4. includes two identical cartridges 402 and 404 separated by a barrier 406. Cartridge 402 is shown with its cover 410 in place. Cartridge 404 is shown with its cover removed for clarity of description. An electrode stored in delivery cavity 446 may draw wire from wire store cavity 462. An electrode stored in delivery cavity 448 may draw wire from wire store cavity 464. Delivery cavities and wire store cavities are formed in cartridge body 409 in any conventional manner (e.g., plastics molding technologies). All terminals are of durable conductive material to resist pitting due to arcing (e.g., brass, steel, stainless steel).

With cover 410 in place, terminals 422 and 424 may cooperate to perform warning and local stun functions as discussed above. Barrier 406 has dimensions and is made of conventional insulating material to prevent arcing between terminal 426 and terminal 424.

Without a cover, terminals 442 and 444 of cartridge 404 may cooperate with launch device terminals 426 and 428 to perform a remote stun function as discussed above.

A propellant, according to various aspects of the present invention, includes structures that control the application of pressurized gas to the electrodes and/or rams. For example, cartridge 108 of FIGS. 1 and 5 includes propellant 114 and a delivery cavity 522. Relatively high pressure gas is released by propellant 114 into delivery cavity 522 in a manner that exhibits desirable repeatability across conventional tolerances for manufacturing processes. Propellant 114 includes electrical interface 501, primer 502, first partition 504, charge 506, staging cavity 508, and second partition 510. A delivery cavity may store any quantity of electrodes to be propelled. For example, delivery cavity 522 stores electrodes 524 and 526 for cartridge 108. Propellant 114 and electrodes 524 and 526 cooperate in a manner as described above with reference to propellant 340 and electrodes 342 and 343 of FIG. 3.

A primer includes any conventional electrically fired pyrotechnic primer. A primer fired by a relatively low voltage and current is preferred to conserve power (e.g., for launch devices operating from battery power). Primer 502 is activated by a signal of interface 501, for example, as provided by a launch circuit of the type described above with reference to launch circuit 318 of FIG. 3.

A first partition provides separation of the primer from the charge to promote repeatable activation of the entire charge. For example, first partition 504 is formed of a perforated brass disc. In another implementation, first partition 504 prevents an anvil of a conventional primer from proceeding into or lodging within staging cavity 508, puncturing second partition 510, or interfering with fluid communication between cavities 508 and 522.

A charge includes any pyrotechnic material for generating sufficient gas pressure and volume to propel electrodes. For example, charge 506 includes from 2 to 10 grains of conventional smokeless pistol powder. A range of effective distances of from 0 to about 40 feet (about 12 meters) can be obtained using from about 0.5 to about 1.5 grains (preferably about 0.75 grain). For this effective distance, conventional electrodes and wire are used with conventional delivery cavity dimensions (e.g., of the type represented by conventional cartridges marketed by TASER International for the model X26 electronic weapon system).

A staging cavity provides a restricted volume to receive gas produced when the charge burns. For example, charge 506 may be located in staging cavity 508, preferably thermally proximate to first partition 504. Staging cavity 508 is assembled within propellant 114 so that staging cavity 508 exhausts gas primarily (e.g., entirely) through second partition 510.

A second partition substantially prevents the flow of pressurized gas from a staging cavity to a delivery cavity until a differential magnitude between the pressure in the staging cavity and the pressure in the delivery cavity is obtained. In other words, fluid communication between a staging cavity and a delivery cavity is not increased until the differential pressure is obtained. The differential pressure effects a sudden change in fluid coupling between the staging cavity and the delivery cavity in any conventional manner, for example, by rupturing a seal of the second partition or rupturing the second partition. For example, second partition 510 may be formed as a thin brass sheet or disc that is ruptured.

Figure 6:
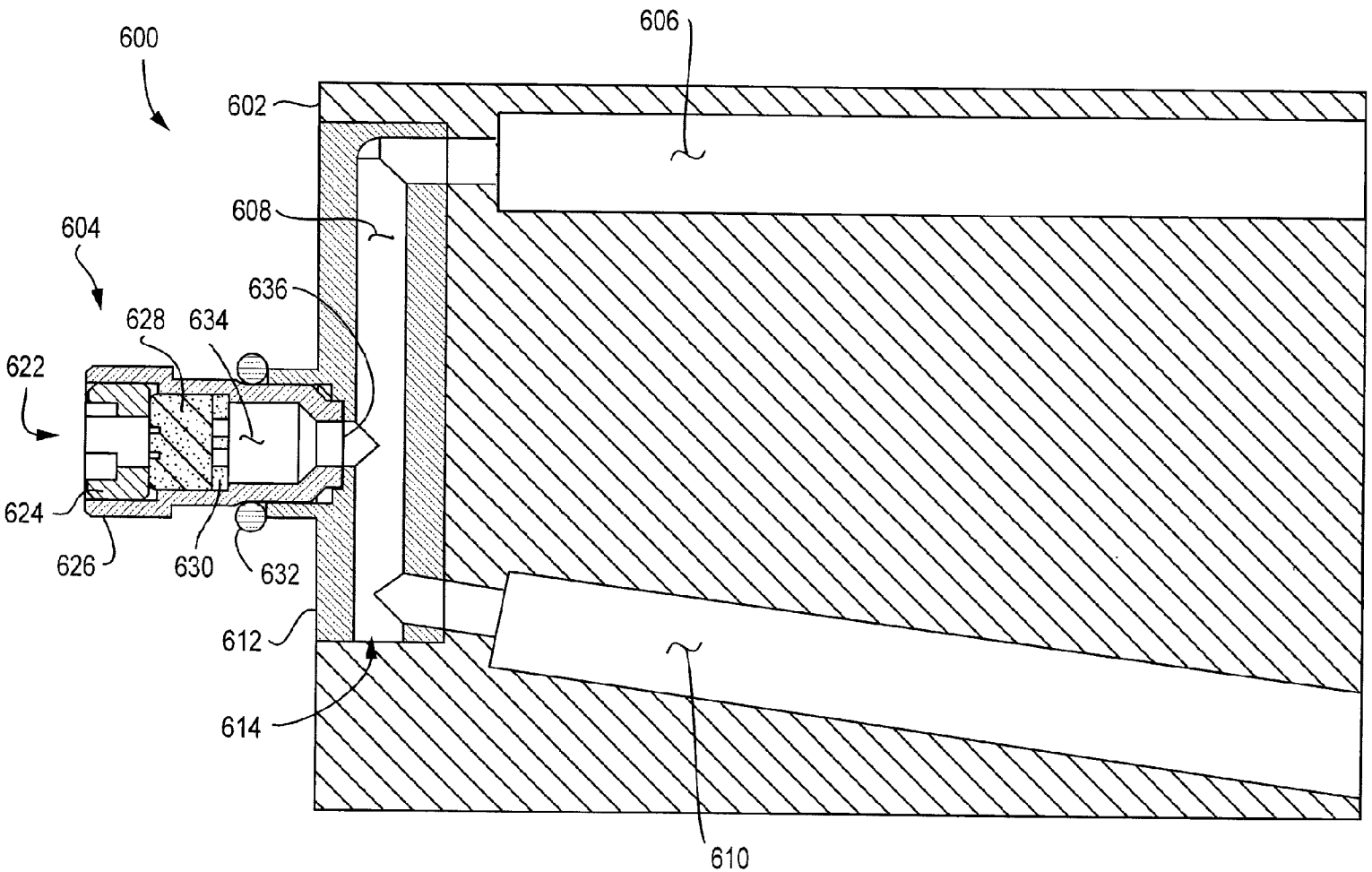
FIG. 6 is a cross section view of a cartridge of the type described in FIG. 5.
Figure 7:
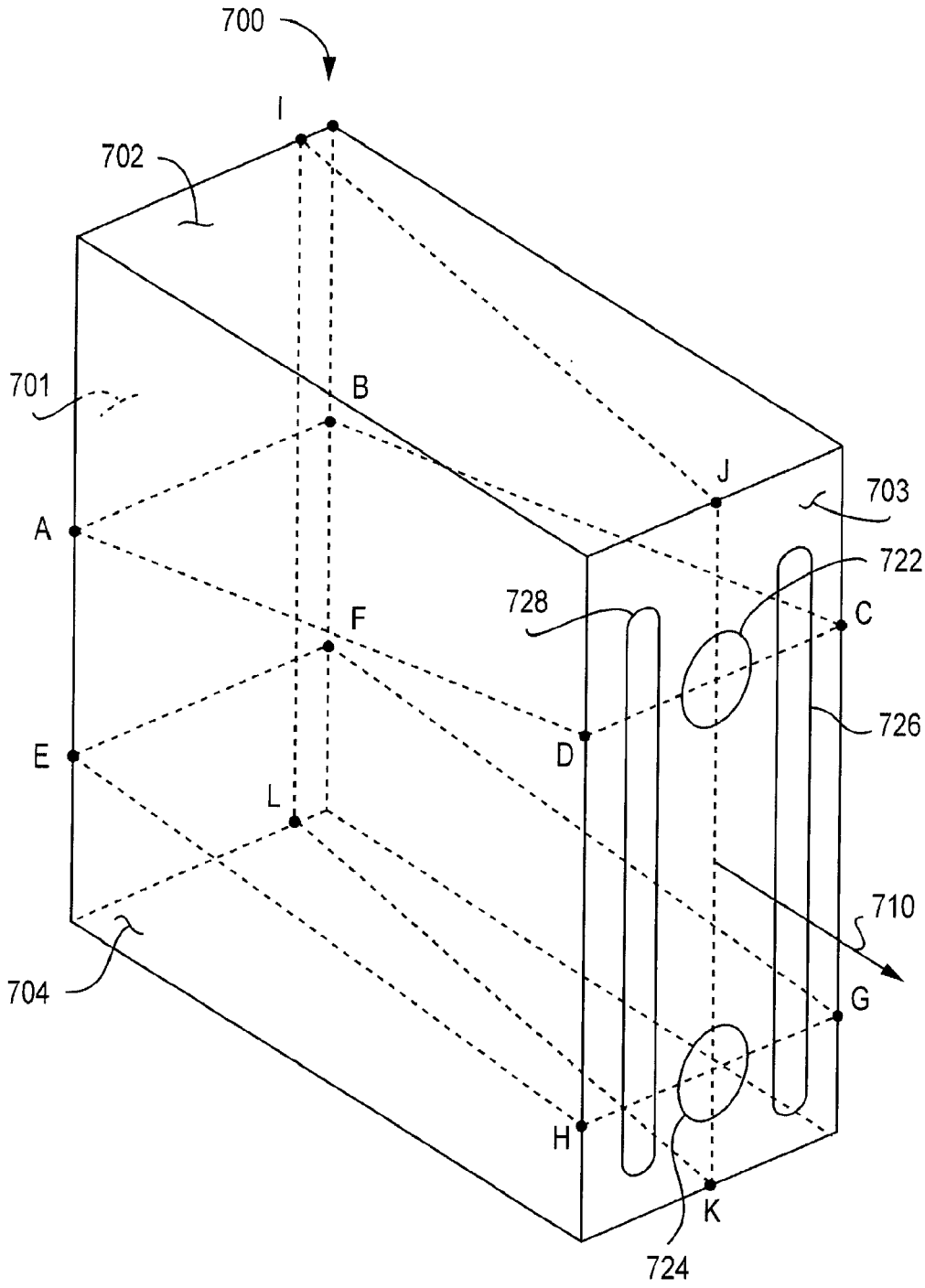
FIG. 7 is a perspective plan view of another cartridge according to various aspects of the present invention.
Figure 8:
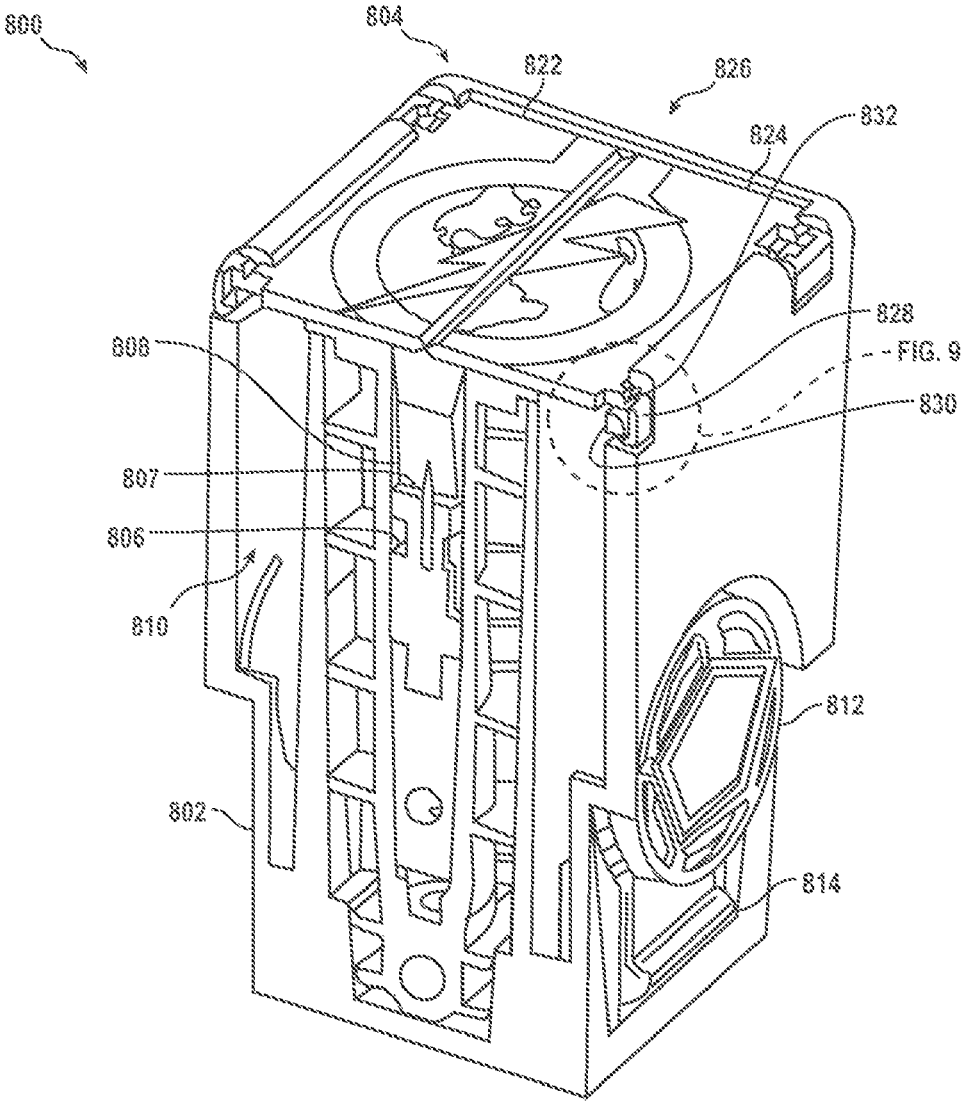
FIG. 8 is a perspective plan view of yet another cartridge according to various aspects of the present invention.
Figure 9:
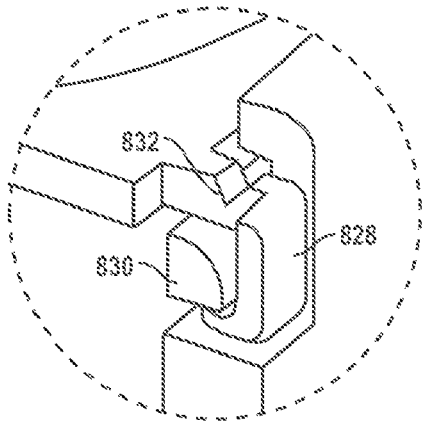
FIG. 9 is an expanded view of a portion of FIG. 8.

An example of a cartridge according to various aspects of the present invention manufactured using conventional materials and processes is shown in cross section in FIG. 6. Cartridge 600 of FIG. 6 is of the type discussed above with reference to cartridge 108, 208, 304, and 404. Cartridge 600 includes cartridge body 602, propellant assembly 604, and manifold 612. When cartridge body 602 and manifold 612 are assembled, a delivery cavity (522) is formed that includes bore 606 (446) for a first electrode (524, 342), bore 608 in manifold 612, and bore 610 (448) for a second electrode (526, 343). The dimensions in FIG. 6 are to scale; relative dimensions may be obtained by comparison to the largest diameter of bore 606 at 0.213 inches (5.41 mm).

A delivery cavity may include a manifold to provide fluid coupling from a single staging cavity to one or more delivery cavities. Here, manifold 612 couples staging cavity 634 to bores 606 and 610. Manifold 612 is cast and/or machined brass and may have an opening 614 that is closed by assembly with cartridge body 602. Cartridge body 602 is formed of plastic.

Propellant assembly 604 includes propellant body 626, stop 624, primer 628, screen 630 (504), o-ring 632, and disc 636 (510). Propellant body 626 and manifold 612 have screw threads (not shown) for fastening propellant body 626 into manifold 612. Other conventional fastening techniques may be used. Disc 636 operates as a second partition 510 as discussed above. Disc 636 seals staging cavity 634 by being mechanically pinched between propellant body 626 and manifold 612. Disc 636 has a thickness of from about 0.001 to about 0.004 inches (0.025 mm to 0.102 mm). O-ring 632 provides a fluid seal between propellant body 626 and manifold 612. Staging cavity 634 is formed within propellant body 626 by conventional machining, and may include a relatively small diameter exit facing disc 636. Screen 630 and primer 628 are held in place by stop 624. Stop 624 and the interior of propellant body 626 have screw threads (not shown) for fastening stop 624 into propellant body 626. Other conventional fastening techniques may be used (e.g., crimping a portion of propellant body 626 over a face of primer 628). Stop 624 has an opening 622 through which an electrical contact may be introduced for butt contact to primer 628. Propellant body 626 forms the return current path to complete the firing circuit for primer 628 which may also include manifold 612.

An electrode that pulls wire from a wire store is affected by the drag of the wire at an angle to the direction of flight of the electrode. Consequently, a population of test firings of the electrode may exhibit a center of distribution at the target that is apart from the intended point of impact. To reduce the distance between the center of distribution and the intended point of impact, the shape of the delivery cavity from which the electrode is propelled may be modified from a purely cylindrical shape aimed in a plane that includes the intended point of impact. For clarity of presentation, consider a cartridge body 700 of FIG. 7 which is a generally rectangular structure with planar faces and 90 degree corners. Cartridge body 700 includes rear face 701, top face 702, front face 703, and side face 704. A reference direction toward the target is represented by axis 710. Cartridge body 700 further includes openings 722, 724, 726 and 728 in front face 703. Opening 722 locates a first bore of a delivery cavity (not shown) that is generally cylindrical having an axis in the plane ABCD where points A and B are in rear face 701 and points C and D are in front face 703. Opening 724 locates a second bore of a delivery cavity (not shown) that is generally cylindrical having an axis in the plane EFGH where points E and F are in rear face 701 and points G and H are in front face 703. Opening 726 and 728 locate the first and second wire stores for bores behind openings 722 and 724 respectively. Plane ABCD has an angle to axis 710 so that the distance between axis 710 and an electrode propelled from opening 722 would initially increase above axis 710. Plane EFGH has an angle to axis 710 so that the distance between axis 710 and an electrode propelled from opening 724 would initially increase below axis 710. Either of planes ABCD and EFGH may be suitably located parallel to axis 710 to accomplish a desired electrode trajectory (e.g., a desired range of effective distance).

According to various aspects of the present invention, the axis of the bore behind opening 722 is included in both planes ABCD and IJKL. Points I and L are in rear face 701, points I and J are in top face 702, and points J and K are in front face 703. In one implementation, plane IJKL differs from a normal with respect to rear face 701 by about 2 degrees. A distance between axis 710 and an electrode propelled from opening 722 would initially increase away from the wire store behind opening 726, thereby compensating for drag that pulls the electrode toward a vertical plane (not shown) through the wire store behind opening 726. The axis of the bore behind opening 724 may be located similarly by analogy and symmetry.

According to various aspects of the present invention, the delivery cavity for an electrode does not have a uniform cylindrical shape. A conventional delivery cavity may have a generally cylindrical shape with a slight widening from rear to face to allow a draft for the plastic mold by which the delivery cavity is formed. Consequently, a cylindrical electrode may be wedged slightly at its base when assembled into the delivery cavity. Further, as the electrode proceeds out of the cavity, it is not in contact with the walls of the cavity. After leaving the cavity, the electrode is subject to drag toward an axis through the wire store. It has been found that reducing the radius of the delivery cavity to produce a "D"-shaped cross section improves electrode accuracy. The flat of the "D" is preferably on the side of the delivery cavity that is closest to the wire store. The flat of the "D" may extend from the front face of the deployment unit rearward at least half the distance of the tube. Use of axis compensation and/or variation in radius improves accuracy of propelled electrodes.

According to various aspects of the present invention, a cartridge may include a segmented cover and fasteners so that it is easily assembled to the cartridge body and is reliably removed by operation of rams as discussed above. For example, cartridge 800 for delivering two electrodes (only one shown) includes body 802, cover 804. Cartridge 800 is shown in partial cross section to reveal cavities and fastener structures discussed below.

Body 802 includes delivery cavity 806, electrode 807, ram 808, wire store cavity 810, recessed button 812, and fastener 814. Fastener 814 allows cartridge 800 to be releasably attached to a launch device (not shown). Depressing recessed button 812 releases cartridge from the launch device.

Cover 804 includes door 822 and door 824 joined at groove 826. An impact by ram 808 (and a similar ram for the other electrode not shown) will urge the material of cover 804 in groove 826 to break and thereby disjoin door 822 from door 824.

Cover 804 as shown is rectangular, having four corners. Cover 804 also includes a fastener at each of its corners. For example, fastener 828 of FIG. 9 at one corner of cover 804 is typical of all four corner fasteners. On installation of cover 804 to cartridge body 802, fastener 828 snaps around post 830 of cartridge body 802. Fastener 828 is joined to door 824 at groove 832. An impact by ram 808 (and similar ram for the other electrode not shown) will urge the material of cover 804 in groove 832 to break and thereby disjoin door 824 from body 802.

In operation, a propellant activated to propel electrode 807 will drive ram 808 against cover 804. First groove 826 will break. Then, each door 822 and 824 will flex away from and apart from the other door. Finally, groove 832 (and other similar grooves in the three other fasteners, not identified) will break. Electrode 807 does not touch either door 822 or 824 during a period of time before one or more segments of the segmented cover have disjoined. Consequently, opening cover 804 is accomplished with a more repeatable quantity of energy than in cartridges of the prior art that use an adhesive seal or plastic weld between the cover and the cartridge body. The energy remaining is spent delivering the electrode to the target in a more repeatable fashion as discussed above.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below. Embodiments of the claimed invention include all practical combinations of the structures and methods discussed above.

What is claimed is:

1. A deployment unit for use with an electronic weapon, the deployment unit comprising:

a. a body comprising a cavity with an opening;

b. an electrode stored in the cavity;

c. an electrical interface and a tether wire, for conducting a current from the electronic weapon through the electrode; and d. a cover coupled to the body over the opening;

e. activation of a provided propellant, in any order (1) provides a force that pushes the cover away from the body to open the cavity; and (2) deploys the electrode from the cavity through the opening toward a provided target for conducting the current through the target that interferes with locomotion by the target; and f. prior to pushing the cover away from the body, no portion of the electrode contacts the cover.

2. The deployment unit of claim 1 further comprising a ram wherein the propellant propels the ram against the cover to provide the force.

3. The deployment unit of claim 2 wherein the propellant propels the electrode to urge the ram against the cover to provide the force.

4. The deployment unit of claim 2 wherein the ram, prior to activation of the propellant, abuts the cover.

5. The deployment unit of claim 2 further comprising the propellant.

6. The deployment unit of claim 2 wherein the ram spaces the electrode from the cover.

7. The deployment unit of claim 1 wherein:

a. the cavity further stores a plurality of electrodes including the electrode;

b. the cavity comprises a manifold for fluid communication between the propellant and each electrode of the plurality; and c. each electrode of the plurality urges a respective ram against the cover to provide the force.

8. The deployment unit of claim 1 further comprising a ram unattached to the electrode and disposed proximate the electrode and proximate the cover, wherein the propellant propels the ram against the cover to provide the force.

9. A deployment unit for use with an electronic weapon, the deployment unit comprising:

a. a body comprising a cavity;

b. an electrode stored in the cavity;

c. an electrical interface and a tether wire, for conducting a current from the electronic weapon through the electrode;

d. a cover comprising at least one fastener that mechanically couples to the body to retain the cover over the cavity; and e. a ram; wherein f. activation of a provided propellant urges the ram against the cover to unfasten the fastener to permit exit of the electrode from the cavity toward a provided target for conducting the current through the target that interferes with locomotion by the target; and g. after exit of the electrode, the ram falls away from the trajectory of the electrode.

10. The deployment unit of claim 9 wherein the propellant propels the electrode to urge the ram to move the cover.

11. The deployment unit of claim 9 further comprising the propellant.

12. The deployment unit of claim 9 further comprising a second fastener that fastens the cover to the body, wherein the ram provides the force equidistant from the fastener and the second fastener.

13. The deployment unit of claim 9 wherein the ram spaces the electrode from the cover.

14. An electronic weapon comprising:

a. a circuit that provides a current;

b. a propellant;

c. a body comprising a cavity;

d. an electrode stored in the cavity;

e. an electrical interface and a tether wire, for conducting the current from the electronic weapon through the electrode; and f. a cover coupled to the body to cover the cavity; wherein g. activation of the propellant, in any order (1) uncovers the cavity; and (2) deploys the electrode from the uncovered cavity toward a provided target for conducting the current through the target that interferes with locomotion by the target; and h. prior to uncovering the cavity, no portion of the electrode contacts the cover.

15. The electronic weapon of claim 14 further comprising a ram wherein the propellant propels the ram against the cover to uncover the cavity.

16. The electronic weapon of claim 15 wherein the propellant propels the electrode to urge the ram against the cover to uncover the cavity.

17. The electronic weapon of claim 15 wherein the ram, prior to activation of the propellant, abuts the cover.

18. The electronic weapon of claim 14 wherein:

a. the cavity further stores a plurality of electrodes including the electrode;

b. the cavity comprises a manifold for fluid communication between the propellant and each electrode of the plurality; and c. each electrode of the plurality urges a respective ram against the cover uncover the cavity.

19. An electronic weapon comprising:

a. a circuit that provides a current;

b. a propellant;

c. a body comprising a cavity;

d. an electrode stored in the cavity;

e. an electrical interface and a tether wire, for conducting the current from the electronic weapon through the electrode;

f. a cover comprising at least one fastener that mechanically couples to the body to retain the cover over the cavity; and g. a ram; wherein h. activation of the propellant urges the ram against the cover to permit exit of the electrode from the cavity toward a provided target for conducting the current through the target that interferes with locomotion by the target; and i. after exit of the electrode, the ram falls away from the trajectory of the electrode.

20. The electronic weapon of claim 19 wherein the propellant propels the electrode to urge the ram against the cover.

21. The electronic weapon of claim 19 wherein the ram spaces the electrode from the cover.

* * * * *